US006641390B2

(12) United States Patent
Genuise

(10) Patent No.: US 6,641,390 B2
(45) Date of Patent: Nov. 4, 2003

(54) RETRACTABLE DEVICE HOLDING ASSEMBLY

(76) Inventor: Coey K. Genuise, 8612 N. Timberlane Dr., Scottsdale, AZ (US) 85258

( * ) Notice: Subject to any disclaimer, the term of this patent is extended or adjusted under 35 U.S.C. 154(b) by 72 days.

(21) Appl. No.: 10/028,194

(22) Filed: Dec. 19, 2001

(65) Prior Publication Data

US 2003/0113680 A1 Jun. 19, 2003

(51) Int. Cl.[7] ..... F23D 11/36
(52) U.S. Cl. ..... 431/253; 431/343; 206/87
(58) Field of Search ..... 431/253, 343; 206/85–89, 94; 24/3.13, 3.7; 224/163, 666, 269, 679

(56) References Cited

U.S. PATENT DOCUMENTS 4,898,532 A * 2/1990 Bercuk ..... 431/253
4,927,354 A * 5/1990 Sanford ..... 431/253
5,788,478 A * 8/1998 DeNoia et al. ..... 431/253
5,788,479 A * 8/1998 Galanos et al. ..... 431/253

* cited by examiner

*Primary Examiner*—James C. Yeung
(74) *Attorney, Agent, or Firm*—Richard R. Mybeck; Peter B. Scull

(57) ABSTRACT

The present invention relates to a unique retractable device holding assembly comprising a spring loaded retractor assembly containing an extendible thread having a relatively flexible polymer ring permanently connect at the free end thereof by an interlocking attachment assembly thereof for securing said ring in circumscription about the body of a utilitarian device and including a clip means for removable attachment to the owners belt, pocket, collar, cigarette pack, key ring, purse or any like location to provide an attractive, handy, secure, and relatively inexpensive device repository where such a repository is desired.

12 Claims, 3 Drawing Sheets

RETRACTABLE DEVICE HOLDING ASSEMBLY

INTRODUCTION

The present invention relates to a retractable device holding assembly and more particularly to a new and improved retractable device holding assembly which permits a utilitarian device to be removably installed therein and, once installed, to be extended for use and thereafter retracted for compact storage at a site of the user's choosing.

BACKGROUND OF THE INVENTION

The use of various means to prevent loss or damage to a free-falling lighter or other like-sized utilitarian device has previously been considered by the art as evidenced, inter alia, by Design Patents 114,210; 152,386; 163,563; 186,052; and 267,597, which show various means for storing a cigarette lighter as well as U.S. Pat. Nos. 4,082,496, 4,486, 169 and 4,898,532 which disclose the use of a retractable tether to return a lighter to an auxiliary storage site unit when the lighter is not in use. While each of the devices provide means for securing a lighter or alternative utilitarian device from free-fall loss or breakage, they all were limited as to size and shape and required a number of supplemental elements which added both to the cost and the complexity of utilizing their benefit to secure and control the location of the lighter or like shape, size or utility device when not in use as well as adapting the device for use with the variety of disposable lighters or other devices of various sizes currently available in the market place. Accordingly, a need still exists for an improved retractable device holding assembly which is economical to produce, easy to install, minimizes the number of auxiliary parts, does not require the user to wear special garments (such as the vest required by Johnson), and which is readily functional with any of the various disposable lighters or alternative devices of various utilitarian functions currently in the market place. It is toward these ends that the present invention is directed.

BRIEF SUMMARY OF THE INVENTION

The present invention relates to a unique retractable device holding assembly comprising a spring loaded retractor assembly containing an extendible thread having a relatively flexible polycarbonate type ring permanently connected at the free end thereof by an interlocking attachment assembly for securing said ring in circumscription about the body of a disposable lighter (commonly referred to as "cigarette lighters", but equally capable of lighting cigars, pipes, birthday candles and the like) or similarly sized or shaped utilitarian devices. The retractor assembly further comprises a clip means for removable attachment to the owners belt, pocket, collar, cigarette pack, key ring, purse or any like location of choice to provide an attractive, handy, secure, and relatively inexpensive source of flame or other utilitarian function where and when such source is desired.

As will be apparent from the following detailed description thereof, the assembly of the present invention overcomes all of the deficiencies present in the prior art devices in a relatively simple though clearly unobvious, solution to the problems manifested by the afore-cited prior art which demonstrates over thirty years of inadequate attempts to achieve this end.

Accordingly, it is the prime object of the present invention to provide a new and improved retractable device holding assembly that has all of the advantages of the prior art device holding restraints and none of the disadvantages.

Another object of the present invention is to provide a new and improved retractable device holding assembly that may be easily and economically manufactured and marketed, and at the same time provide, inter alia, a useful marketing tool for businesses such as convenience stores, gas stations, casinos, tobacco companies, and the like.

A further object of the invention is to provide a new and improved retractable device holding assembly that is durable and reliable in construction.

Still another object of the present invention is to provide an attractive and highly versatile retractable device holding assembly, which is able to accommodate any of the number of disposable hand lighters or similarly utilitarian devices in the market place, irrespective of their shape or size to provide the benefits hereof.

These and still further objects, as may hereinafter appear, are fulfilled by the present invention in a remarkably unexpected fashion as can be readily discerned from careful reading of the following detailed description of a preferred embodiment thereof, especially when read in conjunction with the accompanying drawings in which like parts bear like numerals throughout the several views.

DESCRIPTION OF PREFERRED EMBODIMENT

Figure 1:
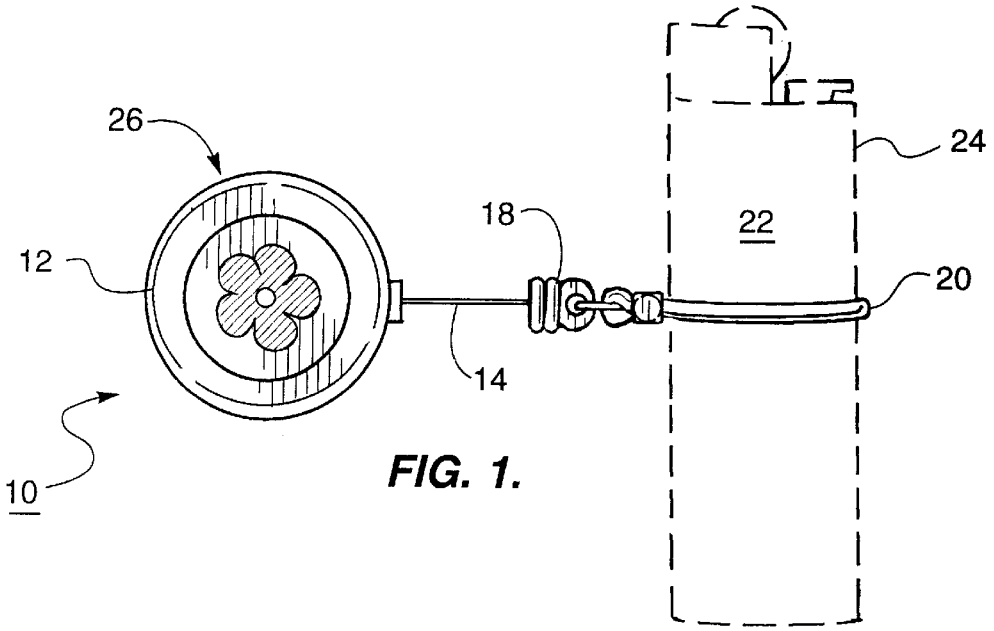
FIG. 1 is a side elevation of a retractable device holding assembly embodying the present invention showing a typical lighter or other utilitarian device in phantom.
Figure 2:
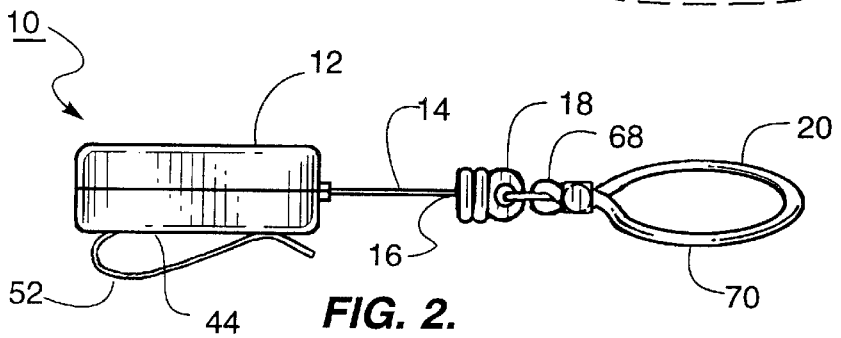
FIG. 2 is a plan view of a retractor member—ring means assembly in accordance with the present invention.

With reference to the drawings and particularly FIGS. 1 and 2, e.g., the retractable device holding assembly of the present invention is designated throughout by the general reference numeral 10 will now be described in detail.

In particular, assembly 10 essentially comprises a retraction member 12 having a tether line 14 extending therefrom and responsive thereto. Tether line 14 has a remote end 16 secured by attachment means 18 to flexible, resilient rubber or plastic ring 20, which in turn is mounted in circumscribing relationship around the body portion 22 of a conventional disposable cigarette lighter or other utilitarian device 24.

As shown in FIGS. 1, 2, 3 and 5, retraction member 12, has a body portion 26 which is shown as cylindrical for illustrative purposes only as it may be rectangular, triangular, oblong and the like. Referring specifically to FIG.

5, body portion 26, is provided with an internal retractor spring 28 which is anchored in a slotted cylindrical portion 30 integrally formed with bottom portion 32 of body portion 26 and is surrounded by a spool 34. The proximal end 36 of tether 14 is secured to spring 28 and wound about spool 34 for responsive co-action therewith when it is desired to extend or retract tether 14 by pulling on or releasing tether 14 using technology already well known in the art.

Retracting member 12 further comprises a lower plate 38 insertable within the bottom portion 32 of body portion 26 to support spool 34 for rotation thereupon and an upper plate 40 for placement upon spool 34 to further facilitate the rotation thereof The upper or lid portion 42 of retraction member 12 is then secured to lower portion 32 so that the extending portion 46 of upper portion 42 complements the extending portion 48 of lower portion 32 which has a groove 50 defined therein into which a complementary shaped hollow spool member 51 is seated, to coact therewith or provide ready ingress and egress for tether 14 into and out of its spring biased-coiled relationship around spool 34.

Figure 3:
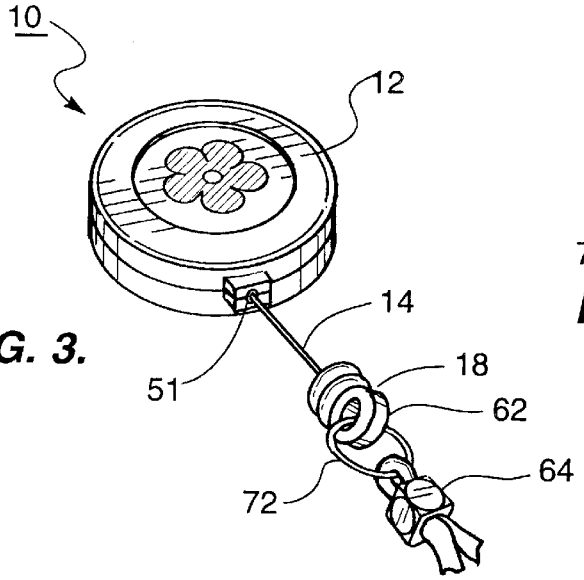
FIG. 3 is an isometric view of the retractor member and interlocking attachment assembly, partially broken away, of the retractable assembly shown in FIGS. 1 and 2.
Figure 4:
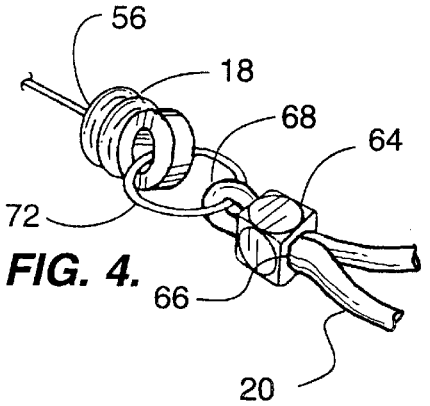
FIG. 4 is an enlarged isometric view of the interlocking attachment assembly of FIGS. 1–3.
Figure 5:
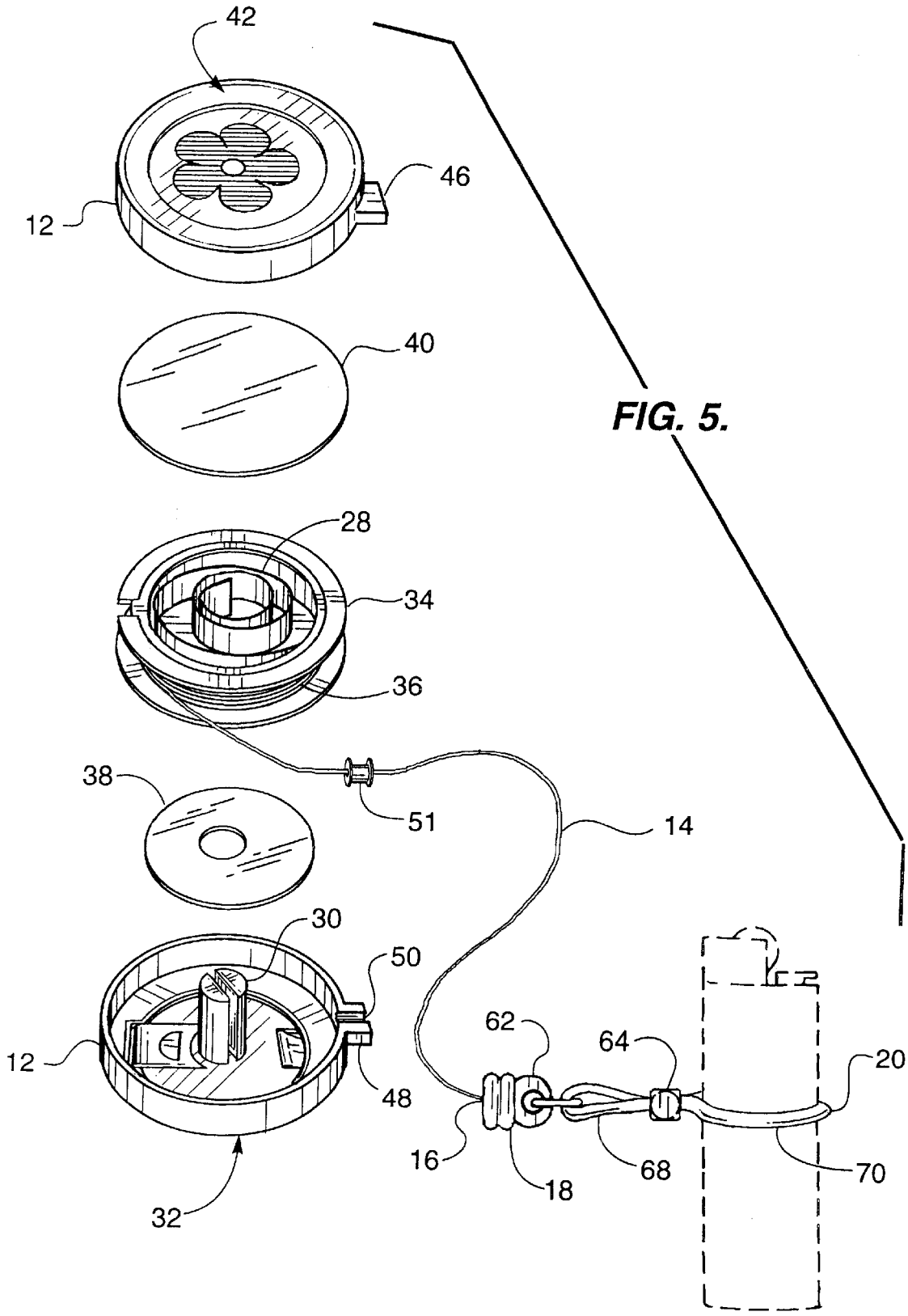
FIG. 5 is an exploded view of the spring-loaded retractor assembly of FIGS. 1–3 showing an alternate lighter or like utilitarian device in phantom; and, FIG. 6 is a side elevation of a retractable device holding assembly embodying the present invention showing a typical utilitarian device in phantom; and, FIG. 7 is a side elevation of a retractable device holding assembly embodying the present invention showing another typical utilitarian device in phantom.

On the external face 44 of lower portion 32 of retraction member 12 is secured a clip 52 for easy attachment of retractor member 12 to the user's belt, pocket, purse, key ring, cigarette pack or like position (not shown) of the user's wearing apparel or carried possession. One manner of securing clip 52 to bottom member 32 is shown in FIG. 5 and comprises a resilient latch portion 54 which extends into the interior of bottom 32. Tether 14 is preferably formed of nylon or other durable synthetic material and is, of course, provided with sufficient length to enable the user to move the lighter or other utilitarian device to the desired area of action, usually, if a lighter, adjacent his/her mouth to light a cigarette, but conceivably to a table top supporting a birthday cake, candle, or like object requiring an active flame to create the desired result, or in the case of a bartender or waitress, to assist clientele in lighting their tobacco material. In the preferred embodiment, as shown in FIGS. 1–3 and enlarged in FIG. 4, attachment means 18 comprises a tether anchor 56 having an aperture (not shown) in the bottom thereof for receiving and securing the distal end 60 of tether 14 and an integral loop portion 62 formed on the opposite end thereof as known in the art. A ring adjustment means 64 shown as cubical in shape and having an opening 66 drilled axially therethrough is dimensioned so as to receive a portion of ring member 20 therethrough so as to provide a first loop 68 and a second loop 70 on the far end thereof when ring 20 is compressed and fed through opening 66 of ring adjustment means 64 or cinch 64 and is then attached to loop portion 62 of tether anchor 56 by means of connecting ring 72. Extending loop 70 of ring 20, which circumscribes a lighter 24 or the like, is thus secured to tether 14 and hence retraction means 12.

Figure 6:
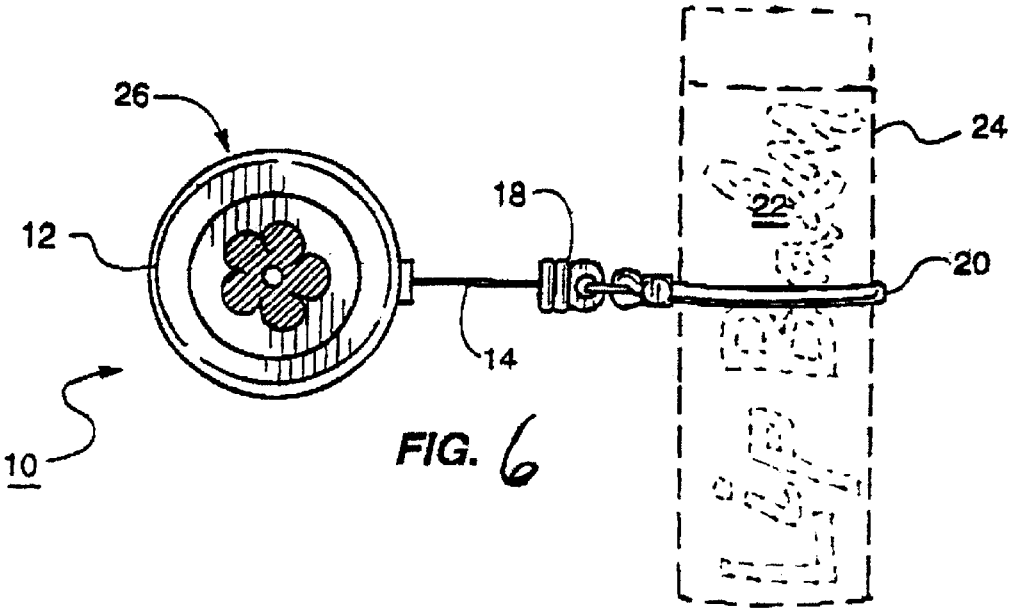
Figure 7:
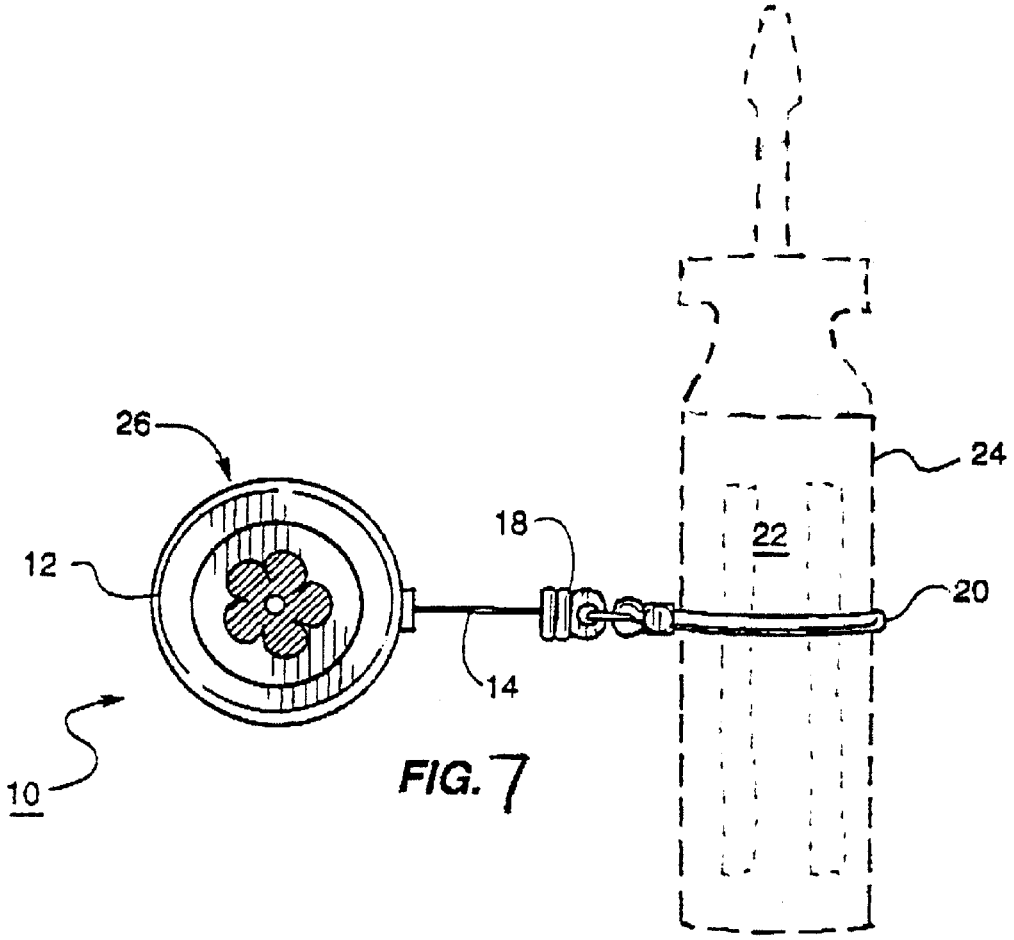

While the foregoing assembly has been described in terms of a cigarette lighter, it can be equally useful in controlling the whereabouts of similarly shaped objects such as small flashlights, screwdrivers and similar tools, marking pens, cosmetic products, lip balm, and like small and lightweight items. Examples hereof are shown in FIGS. 6 and 7 wherein alternative devices 24 are shown in phantom.

As to the manner of usage and operation of the present invention, it is believed that such is readily apparent from the above description and accordingly no further discussion relative to the usage and operation of the assembly is deemed necessary other than to say that the selected device is used when the tether is drawn a preselected distance from the retraction device and used while maintaining one's grip thereupon. When the desired task is complete, the selected device (e.g. lighter or alternative device) is released and the spring 28 in retractor means 12 rewinds the tether 14 and returns the device to its at rest position adjacent retraction device 12.

In view of the foregoing, it is respectfully submitted that all of the aforestated objects have been fulfilled by the present invention in a remarkably unexpected fashion and that such applications, modifications and alterations as may readily occur to one having ordinary skill in the art to which this invention pertains are included within the scope of this disclosure which is limited only by the scope of the claims appended hereto.

Accordingly what is claimed is:

1. A retractable device holding assembly comprising: a retraction member; a ring member; attachment means; an object; a tether line having a proximal and a distal end; said proximal end being secured to said retraction member and responsive thereto and said distal end being secured to said attachment means; said attachment means having a rigid loop portion integrally formed therewith and adapted to receive said ring member therein in pivotal relationship thereto; an elastic O-ring; and ring adjustment means adapted to receive a portion of said O-ring therethrough to define a first loop and a second loop therewith; said first loop being connected by said ring member to said loop on said attachment means and said second loop being stretchable about said object; said ring adjustment means being movable on said O-ring to vary the size of said first and said second loop so that said second loop tightly encircles said object; and allows said object to be moved between an extended operational position and an inactive position adjacent said retraction member.

2. An assembly accordingly to claim 1 in which said retraction member comprises a housing; a cylindrical spool mounted for rotation within said housing; a retractable spring means mounted in said housing in operative relationship to said spool; and a tether line secured to said spool and reeved there around and extending therefrom for movement therewith; said spring means being compressed in response to the withdrawal of a length of said tether from said housing and automatically decompressed when the compression force is removed therefrom.

3. An assembly according to claim 2 in which said object is a lighter.

4. An assembly according to claim 2 in which said object is a cosmetic product.

5. An assembly according to claim 4 in which said cosmetic product is lip balm.

6. An assembly according to claim 5 in which said tool is a screwdriver.

7. An assembly according to claim 5 in which said tool is a flashlight.

8. An assembly according to claim 5 in which said tool is a marker.

9. An assembly according to claim 8 in which said tool is a pen.

10. An assembly according to claim 8 in which said tool is a pencil.

11. An assembly according to claim 5 in which said tool is a writing device.

12. An assembly according to claim 2 in which said object is a tool.

* * * * *